US010418203B2

(12) United States Patent
Enomoto et al.

(10) Patent No.: US 10,418,203 B2
(45) Date of Patent: Sep. 17, 2019

(54) VENTED PUSH SWITCH

(71) Applicant: Panasonic Intellectual Property Management Co., Ltd., Osaka (JP)

(72) Inventors: Masatoshi Enomoto, Okayama (JP); Tomoki Kuroyabu, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/061,360

(22) PCT Filed: Feb. 7, 2017

(86) PCT No.: PCT/JP2017/004306
§ 371 (c)(1),
(2) Date: Jun. 12, 2018

(87) PCT Pub. No.: WO2017/145733
PCT Pub. Date: Aug. 31, 2017

(65) Prior Publication Data

US 2018/0366282 A1 Dec. 20, 2018

(30) Foreign Application Priority Data

Feb. 23, 2016 (JP) ..... 2016-031540

(51) Int. Cl.
*H01H 9/04* (2006.01)
*H01H 13/10* (2006.01)
(Continued)

(52) U.S. Cl.
CPC ..... *H01H 13/06* (2013.01); *H01H 9/04* (2013.01); *H01H 13/10* (2013.01); *H01H 13/52* (2013.01);
(Continued)

(58) Field of Classification Search
CPC ..... H01H 13/06; H01H 13/10; H01H 13/52; H01H 9/04; H01H 2213/002; H01H 2209/016; H01H 2209/012; H01H 2227/02
See application file for complete search history.

(56) References Cited

U.S. PATENT DOCUMENTS 4,619,481 A * 10/1986 Grudzinskas ..... A47C 7/467 297/284.1
5,658,050 A * 8/1997 Lorbiecki ..... B62J 1/12 297/452.41
(Continued)

FOREIGN PATENT DOCUMENTS

CN 102254724 A 11/2011
JP 2003-234040 A 8/2003
JP 2013-191482 9/2013

OTHER PUBLICATIONS

International Search Report of PCT application No. PCT/JP2017/004306 dated May 9, 2017.
(Continued)

*Primary Examiner* — Vanessa Girardi
(74) *Attorney, Agent, or Firm* — McDermott Will & Emery LLP

(57) ABSTRACT

A push switch of the present disclosure has: a resin case that has a recess, a through hole, and a groove; a connection terminal; an upper protection sheet; and a lower protection sheet. The through hole penetrates from a bottom part of the recess to a lower surface of the resin case, and the groove is provided on the lower surface of the resin case. The through hole and the groove are connected to each other, and the through hole overlaps with the lower protection sheet in plan view. The groove has a first area and a second area, and of
(Continued)

the first area and the second area, only the first area overlaps with the lower protection sheet in plan view.

9 Claims, 5 Drawing Sheets

(51) Int. Cl.
*H01H 13/06* (2006.01)
*H01H 13/52* (2006.01)

(52) U.S. Cl.
CPC . *H01H 2209/012* (2013.01); *H01H 2209/016* (2013.01); *H01H 2213/002* (2013.01); *H01H 2227/02* (2013.01)

(56) References Cited

U.S. PATENT DOCUMENTS

| | | | | | |
|---|---|---|---|---|---|
| 5,895,900 | A * | 4/1999 | Okada | B60N 2/002 | 200/306 |
| 7,542,299 | B2 * | 6/2009 | Chen | G06F 3/023 | 361/752 |
| 7,741,573 | B2 * | 6/2010 | Masuda | H01H 13/06 | 200/406 |
| 2011/0284351 | A1 * | 11/2011 | Kitahara | H01H 13/06 | 200/341 |

OTHER PUBLICATIONS

English Translation of Chinese Search Report dated May 15, 2019 for the related Chinese Patent Application No. 201780010413.X.

* cited by examiner

VENTED PUSH SWITCH

This application is a U.S. national stage application of the PCT International Application No. PCT/JP2017/004306 filed on Feb. 7, 2017, which claims the benefit of foreign priority of Japanese patent application No. 2016-031540 filed on Feb. 23, 2016, the contents all of which are incorporated herein by reference.

TECHNICAL FIELD

The present disclosure relates to a push switch used for various electronic devices.

BACKGROUND ART

Hereinafter, a conventional push switch will be described. A conventional push switch includes a resin case, an upper protection sheet, and a lower protection sheet. The resin case includes a recess and a through hole. The through hole is formed in a bottom part of the recess. The upper protection sheet covers the recess. Meanwhile, the lower protection sheet is provided on a lower surface of the resin case.

It should be noted that, for example, PTL 1 is known as a prior art document containing information related to the invention in this application.

CITATION LIST

Patent Literature

PTL 1: Unexamined Japanese Patent Publication No. 2013-191482

SUMMARY OF THE INVENTION

An aspect of the present disclosure includes, as a push switch, a resin case that has a recess, a through hole, and a groove, a connection terminal that extends from a first side surface of the resin case toward an outside of the resin case, an upper protection sheet that is provided on an upper surface of the resin case in such a manner as to cover the recess, and a lower protection sheet that is provided on a lower surface of the resin case. The through hole penetrates from a bottom part of the recess to the lower surface of the resin case, the groove is provided on the lower surface of the resin case, the through hole and the groove are connected, the through hole overlaps with the lower protection sheet in plan view, and the groove has a first area and a second area, and of the first area and the second area, only the first area overlaps with the lower protection sheet in plan view.

DESCRIPTION OF EMBODIMENT

Figure 1:
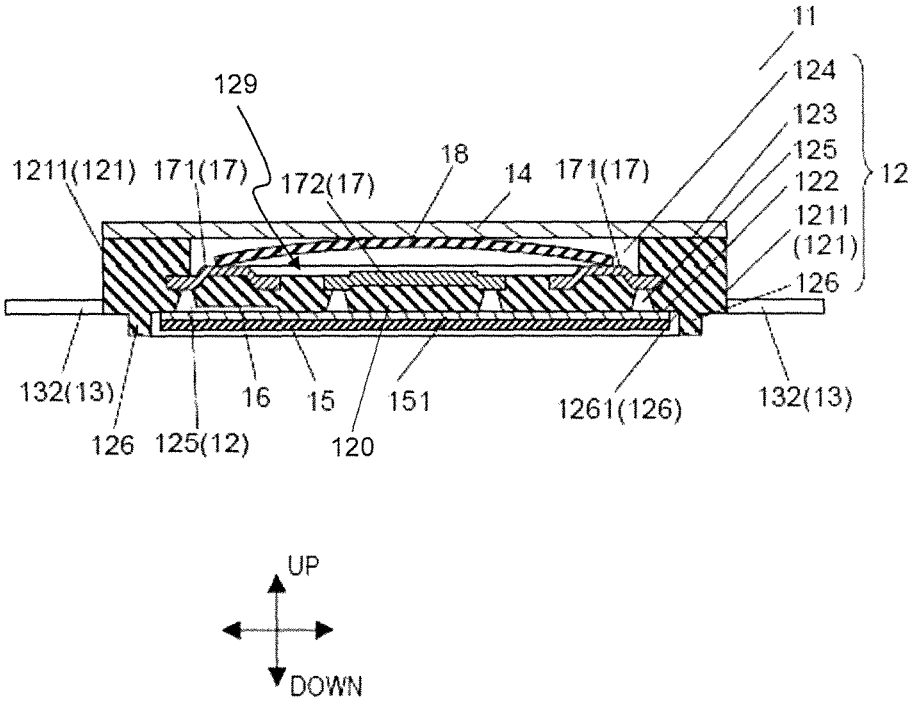
FIG. 1 is a cross-sectional view of a push switch in an exemplary embodiment of the present disclosure.

Before describing exemplary embodiments of the present disclosure, a problem in a conventional device will be briefly described.

In a conventional drip-proof push switch, an upper surface of a resin case is sealed by a protection sheet. Hence, heat from reflow soldering the push switch may expand the air inside the resin case, and deform or break the protection sheet or the resin case.

Against this background, the present disclosure can suppress deformation or breakage of a protection sheet and a resin case caused by heat from reflow soldering.

An exemplary embodiment of a push switch and the like will be described with reference to the accompanying drawings. It should be noted that components assigned the same reference numerals in the exemplary embodiment operate similarly, and therefore redundant descriptions may be omitted.

In the present disclosure, terms indicating directions, such as "upper", "lower", "upper surface", "lower surface" and the like only indicate relatively positional relationships, and the present disclosure is not limited thereto.

Exemplary Embodiment

Figure 2:
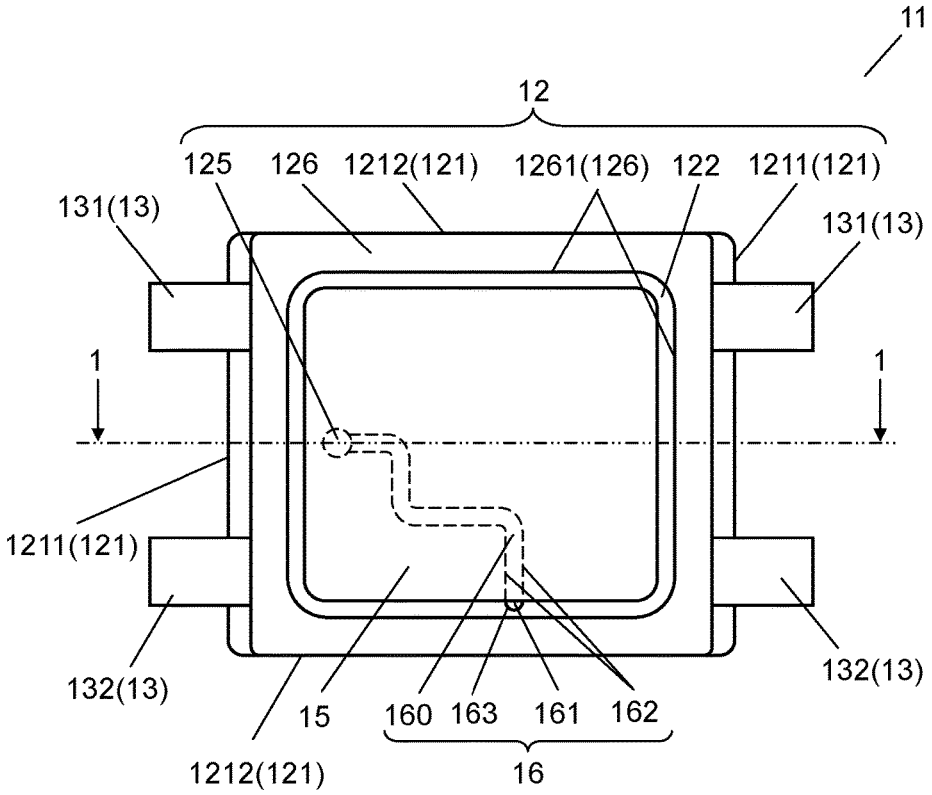
FIG. 2 is a bottom view of the push switch in the exemplary embodiment of the present disclosure.
Figure 3:
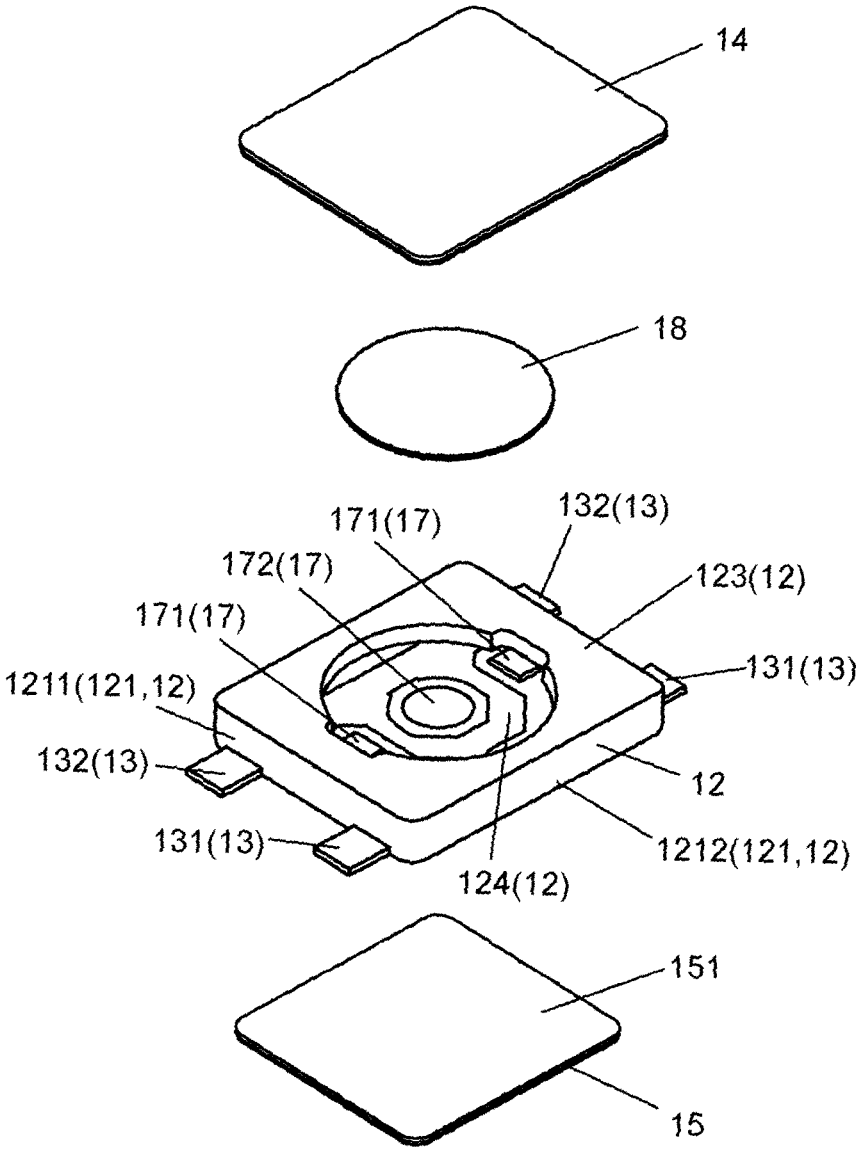
FIG. 3 is an exploded perspective view of the push switch in the exemplary embodiment of the present disclosure.
Figure 4:
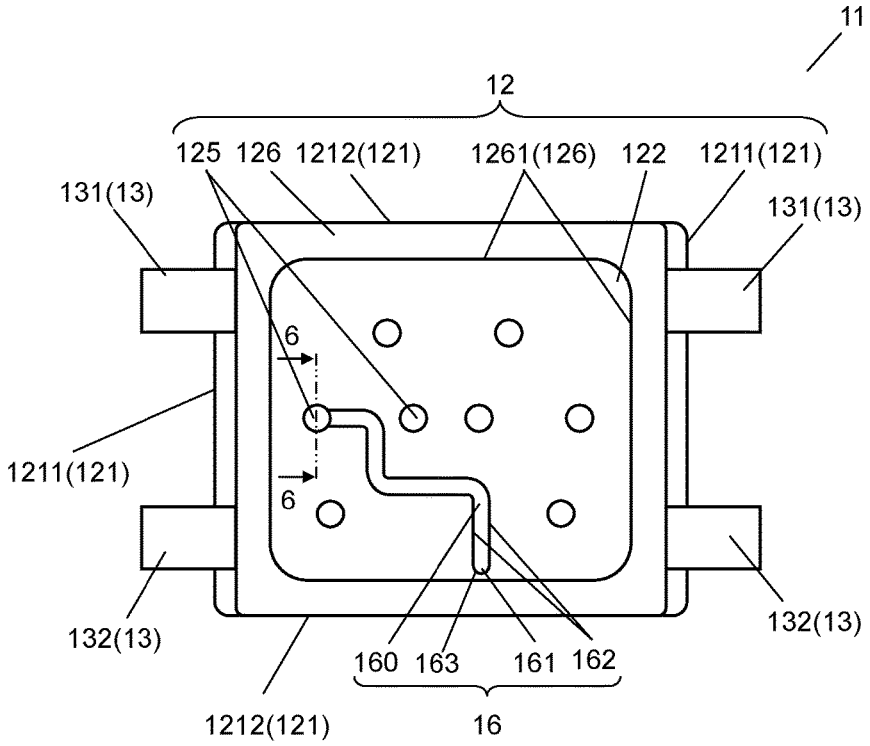
FIG. 4 is a bottom view of the push switch in the exemplary embodiment of the present disclosure from which a lower protection sheet is removed.
Figure 5:
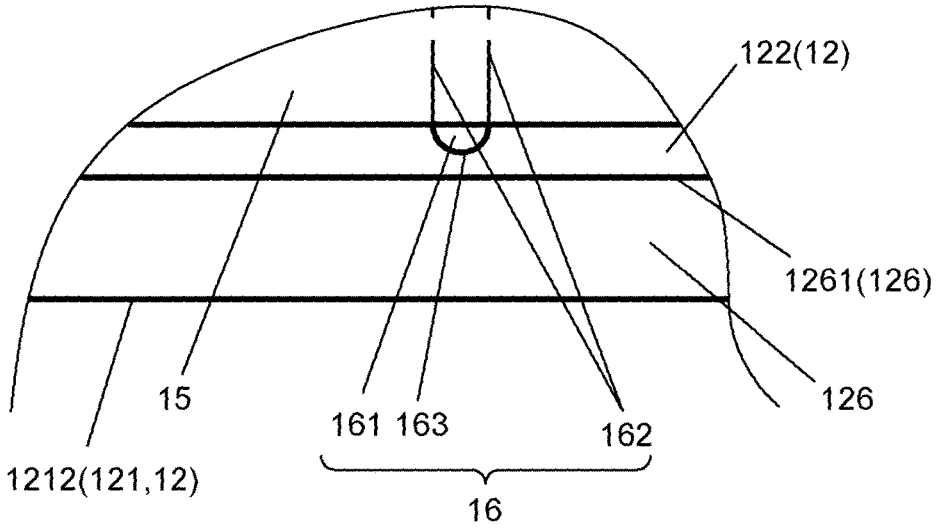
FIG. 5 is an enlarged view of a main part of the push switch in the exemplary embodiment of the present disclosure as viewed from below.
Figure 6:
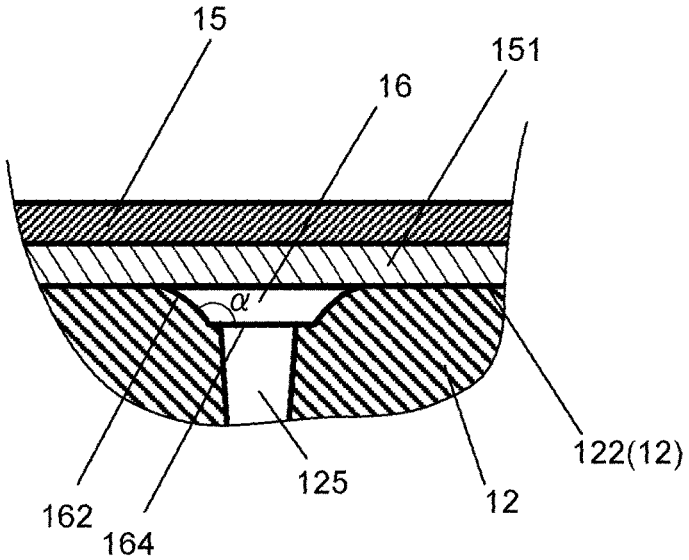
FIG. 6 is an enlarged cross-sectional view of a main part of the push switch in the exemplary embodiment of the present disclosure.

FIG. 1 is a cross-sectional view of push switch 11. FIG. 2 is a bottom view of push switch 11. FIG. 3 is an exploded perspective view of push switch 11. FIG. 4 is a bottom view of push switch 11 from which lower protection sheet 15 is removed. FIG. 5 is an enlarged view of a main part of push switch 11 as viewed from below. It should be noted that FIG. 1 illustrates a state where push switch 11 is cut along section line 1-1 illustrated in FIG. 2. FIG. 6 illustrates a state where push switch 11 is cut along section line 6-6 illustrated in FIG. 4.

Hereinafter, push switch 11 used for various electronic devices (not shown) will be described with reference mainly to FIGS. 1 and 2. Push switch 11 includes resin case 12, connection terminals 13, upper protection sheet 14, lower protection sheet 15, multiple fixed contacts 17, and movable contact 18. Resin case 12 includes side surfaces 121, lower surface 122, upper surface 123, recess 124, through holes 125, and groove 16. Of multiple side surfaces 121, a side surface from which connection terminal 13 extends is indicated as first side surface 1211. As illustrated in FIG. 2, groove 16 has area 160 (first area) that overlaps with lower protection sheet 15 in plan view, and exposed part 161 (second area) that does not overlap with lower protection sheet 15 in plan view. It should be noted that plan view in the present disclosure refers to viewing from below or above, as in FIG. 2.

As illustrated in FIG. 1, through hole 125 penetrates from a bottom 129 of recess 124 to lower surface 122 of resin case 12. Groove 16 is formed in lower surface 122 of resin case 12. Connection terminal 13 extends from first side surface 1211 toward the outside of resin case 12. Upper protection sheet 14 is provided on upper surface 123 of resin case 12 in such a manner as to cover recess 124. Lower protection sheet 15 is provided on lower surface 122 of resin case 12.

Multiple fixed contacts 17 (first fixed contact 171, second fixed contact 172) are provided inside resin case 12. It should be noted that a part of each of multiple fixed contacts 17 is buried in resin case 12, and the part is exposed from resin case 12 in the bottom 129 of recess 124. Multiple fixed contacts 17 are electrically connected with corresponding connection terminals 13. Meanwhile, movable contact 18 is provided inside recess 124.

For example, in push switch 11 illustrated in FIG. 1, contact between movable contact 18 and second fixed contact 172 can electrically connect first fixed contact 171 and second fixed contact 172. Moreover, separation of movable contact 18 from second fixed contact 172 electrically separates multiple fixed contacts 17.

Moreover, as illustrated in FIG. 2, of groove 16, the area that overlaps with lower protection sheet 15 in plan view is indicated as area 160 (first area), and the area exposed from lower protection sheet 15 is indicated as exposed part 161.

According to the above configuration, even if the air inside resin case 12 is expanded by heat from reflow soldering, the air inside recess 124 is allowed to pass through through hole 125 and groove 16, and be released to the outside of push switch 11 from exposed part 161. Accordingly, it is possible to suppress deformation or breakage of upper protection sheet 14, lower protection sheet 15, and resin case 12 caused by heat from reflow soldering.

By providing groove 16, creepage distance from exposed part 161 to through hole 125 can be extended. Hence, entry of flux from the outside to the inside of recess 124 can be suppressed during reflow soldering. Accordingly, flux is less likely to reach parts where multiple fixed contacts 17 and movable contact 18 come into contact. As a result, flux is less likely to hinder contact between multiple fixed contacts 17 and movable contact 18.

Hereinafter, a specific configuration of push switch 11 will be described in detail. Push switch 11 is mounted on a printed circuit board (not shown). The printed circuit board is stored in a casing of an electronic device such as portable equipment. In recent years, such electronic devices have been required to be thinner. Examples of portable equipment include a tablet terminal, and a keyboard used by being attached to the tablet terminal. Push switch 11 is required to be thinner. Accordingly, the thickness of resin case 12 is also required to be smaller. Hence, the thickness of the bottom part 120 of the resin case 12 at recess 124 is formed small. The thickness of resin case 12 in recess 124 is 0.175 millimeters, for example.

Push switch 11 is reflow-soldered on a printed circuit board (not shown). In order to prevent fusing and avoid deformation of resin case 12 by heat from reflow soldering, resin case 12 is formed of heat-resistant thermosetting resin. Upper protection sheet 14 and lower protection sheet 15 are also formed of heat-resistant resin, to prevent fusing by heat from reflow soldering. According to the above configuration, push switch 11 can suppress deformation of resin case 12, even if the thickness of resin case 12 is reduced. Hence, the thickness of an electronic device can be reduced.

Recent electronic devices are also required to have high waterproofing performance. Accordingly, push switch 11 is also required to have high waterproofing performance and high drip-proofing performance. For this reason, it is preferable that an outer peripheral part of upper protection sheet 14 and upper surface 123 of resin case 12 be coupled by welding or the like. Upper protection sheet 14 and resin case 12 are coupled by laser welding, for example. Upper protection sheet 14 and upper surface 123 of resin case 12 are coupled tightly by laser welding. Thus, entry of water or the like into recess 124 from between upper protection sheet 14 and upper surface 123 of resin case 12 can be avoided.

Even if upper protection sheet 14 and upper surface 123 of resin case 12 are tightly coupled by the method described above, in push switch 11 of the exemplary embodiment, the air inside recess 124 can be released to the outside from exposed part 161. It should be noted that upper protection sheet 14 is not necessarily coupled with resin case 12 by welding. Upper protection sheet 14 may be coupled with resin case 12 by an adhesive agent.

Meanwhile, as illustrated in FIG. 6, lower protection sheet 15 is adhered to lower surface 122 of resin case 12 by adhesive agent 151. It should be noted that lower protection sheet 15 and adhesive agent 151 are formed of heat-resistant resin. Polyimide may be used as lower protection sheet 15, for example. Epoxy resin may be used as adhesive agent 151 of lower protection sheet 15, for example. Heat-resistant resin such as epoxy resin has low fluidity at room temperature. Since adhesive agent 151 is formed of resin that has low fluidity at room temperature, blockage of groove 16 can be avoided. As a result, the air inside recess 124 passes through a space surrounded by groove 16 and adhesive agent 151, and is released to the outside.

It should be noted that an underfill (not shown) such as resin preferably fills a gap between lower protection sheet 15 and the printed circuit board. It should also be noted that the underfill is filled after reflow soldering of push switch 11. When filling the underfill, it is preferable that exposed part 161 be closed with resin. With this configuration, entry of water or the like into push switch 11 from the outside can be avoided.

As illustrated in FIG. 2, it is preferable that groove 16 extend to the outside of the peripheral edge of lower protection sheet 15. With this configuration, no hole or the like needs to be machined in lower protection sheet 15. That is, this configuration can adopt lower protection sheet 15 of the push switch in which no hole or the like is machined.

It should be noted that a hole or a cutout (not shown) may be provided in lower protection sheet 15, and groove 16 may be exposed from the hole or cutout. In a configuration in which lower protection sheet 15 has a hole or a cutout, an area where groove 16 overlaps with the hole (or cutout) of lower protection sheet 15 is exposed part 161 (second area) of groove 16.

Resin case 12 includes first side surfaces 1211 and second side surfaces 1212. The side surface from which connection terminal 13 protrudes is first surface 1211, and the side surface from which connection terminal 13 does not protrude is second side surface 1212. It is preferable that groove 16 extend toward the side surface from which connection terminal 13 does not protrude (second side surface 1212). With this configuration, exposed part 161 can be disposed in a position away from connection terminal 13, so that flux is less likely to reach exposed part 161 during reflow soldering.

As illustrated in FIG. 2, resin case 12 is rectangular, for example, when viewed from below. Of four side surfaces 121, two first side surfaces 1211 are provided on opposite side surfaces. Of four side surfaces 121, two side surfaces 121 other than first side surfaces 1211 are second side surfaces 1212. It should be noted that resin case 12 is not limited to the rectangular shape, and may be a polygon. Moreover, multiple first side surfaces 1211 do not necessarily have to be disposed opposite to each other, but may be disposed adjacent to each other. When resin case 12 has multiple second side surfaces 1212, the second side surfaces 1212 do not necessarily have to be disposed opposite to each other but may be disposed adjacent to each other, as in the case of first side surfaces 1211. A number of first side surfaces 1211 to be provided in resin case 12 is not limited to two, but may be one, three, or more. It should be noted, however, that even in such cases, resin case 12 preferably includes one or more second side surfaces 1212.

As illustrated in FIG. 1, multiple fixed contacts 17 include first fixed contacts 171 and second fixed contact 172. Connection terminal 13 includes first connection terminals 131 and second connection terminals 132. It should be noted that first connection terminal 131 includes a first joint (not shown). First fixed contact 171 is electrically connected to the first joint. Meanwhile, second connection terminal 132 includes a second joint (not shown). Second fixed contact 172 is electrically connected to the second joint. Hence, fixed contacts 17 and connection terminals 13 are formed of a metal material. It should be noted that first fixed contact 171 and first connection terminal 131 are preferably formed integrally by pressing or the like. It should be noted that second fixed contact 172 and second connection terminal 132 are preferably formed integrally by pressing or the like.

Part of or all of the first joint and second joint are buried in resin case 12. For example, first connection terminal 131 and second connection terminal 132 may be insert-molded into resin case 12, to bury the first joint and second joint into resin case 12.

It should be noted that a molded part such as resin case 12 generally shrinks by cooling during molding. For this reason, when insert-molding first connection terminal 131 and second connection terminal 132 into resin case 12, the difference in the coefficients of linear expansion of resin and metal may generate a slight gap between resin case 12 and multiple fixed contacts 17 and joints. Hence, the air inside recess 124 can pass through the gap between multiple fixed contacts 17 and joints, and resin case 12, and reach through hole 125. It should be noted that the configuration is not limited to the above, and a passage for guiding the air inside recess 124 to through hole 125 may be formed in resin case 12.

During insert molding, first fixed contact 171, second fixed contact 172, the first joint of first connection terminal 131, and the second joint of second connection terminal 132 are positioned by being supported by multiple support pins. That is, when molding resin case 12, the support pins form pin holes in lower surface 122 of resin case 12. Hence, the pin hole for receiving the first joint may also be used as through hole 125.

It should be noted that through hole 125 is not limited to use of the pin hole formed by the pin that receives the first joint. Any of the pin hole formed by the pin that receives the second joint, the pin hole formed by the pin that receives first fixed contact 171, and the pin hole formed by the pin that receives second fixed contact 172 may be used. Moreover, through hole 125 is not limited to use of only one of the pin holes, and multiple pin holes may be used. In this case, groove 16 is connected to each of multiple through holes 125. Furthermore, in this case, groove 16 may be configured to be connected to multiple through holes 125

As illustrated in FIG. 4, the start point of groove 16 coincides with through hole 125. However, the configuration is not limited to this, and through hole 125 may be joined with groove 16 at an intermediate part of groove 16. A number of exposed parts 161 in groove 16 is not limited to one, and multiple exposed parts 161 may be provided.

It is preferable that groove 16 extend in a bent manner. If groove 16 is bent, creepage distance from exposed part 161 to through hole 125 is extended. Hence, with this configuration, entry of flux into recess 124 from the outside during reflow soldering can be avoided. Groove 16 may branch from an intermediate part of groove 16. In this case, exposed part 161 may be formed in one end of branched groove 16, or may be formed in both ends of branched groove 16. Part of or the entire groove 16 may be formed into an annular shape.

Groove 16 includes groove side surface 162 and end 163. In a configuration in which exposed part 161 is formed in end 163 of groove 16, if the tip end of end 163 and groove side surface 162 form an angle, flux may enter the groove from the corner by capillarity. For this reason, in the exemplary embodiment, end 163 is formed into a curve when viewed from below, as illustrated in FIG. 5. That is, end 163 and groove side surface 162 are connected by a smooth curve in plan view. This is a preferred configuration. Moreover, it is also preferable that bottom 164 of groove 16 and groove side surface 162 intersect at an obtuse angle (indicated by a in FIG. 6), as illustrated in FIG. 6. With these configurations, flux is less likely to reach through hole 125 by capillarity.

As illustrated in FIG. 1, it is preferable that wall 126 is also formed in the lower surface of resin case 12. Wall 126 protrudes from the lower surface of resin case 12. In this case, as illustrated in FIG. 5, wall 126 is disposed away from groove 16 and through hole 125 illustrated in FIG. 4. If wall 126 is not disposed away from groove 16 and through hole 125 illustrated in FIG. 4, flux having flowed in by capillarity along corner 1261 formed by wall 126 and lower surface 122 may enter groove 16. For this reason, by disposing wall 126 away from groove 16 and through hole 125 illustrated in FIG. 4, flux is less likely to reach groove 16.

As illustrated in FIG. 2, it is preferable that wall 126 be disposed between lower protection sheet 15 and connection terminal 13. During reflow soldering, viscosity of flux included in a solder paste supplied to the position of connection terminal 13 is lowered by heating. Accordingly, flux is likely to enter the lower side of push switch 11. By disposing wall 126 between lower protection sheet 15 and connection terminal 13, wall 126 can keep flux from reaching groove 16. Moreover, it is preferable that wall 126 surround the outer periphery of lower protection sheet 15. With this configuration, entry of flux into the inside of wall 126 can be suppressed. Hence, entry of flux into groove 16 can be suppressed.

SUMMARY

As illustrated in FIGS. 1 and 2, push switch 11 of the present disclosure is configured in the following manner.

Resin case 12 has recess 124, through hole 125, and groove 16. Connection terminal 13 extends from first side surface 1211 of resin case 12, toward the outside of resin case 12. Upper protection sheet 14 is provided on the upper surface of resin case 12 in such a manner as to cover recess 124. Moreover, lower protection sheet 15 is provided on lower surface 122 of resin case 12. Through hole 125 penetrates from the bottom 129 of recess 124 to lower surface 122 of resin case 12. Groove 16 is provided on lower surface 122 of resin case 12. Through hole 125 and groove 16 are connected to each other. Through hole 125 overlaps with lower protection sheet 15 in plan view. Groove 16 has area 160 (first area) and exposed part 161 (second area), and of area 160 and exposed part 161, only area 160 overlaps with lower protection sheet 15 in plan view. In other words, exposed part 161 does not overlap with lower protection sheet 15 in plan view.

Hence, according to push switch 11 of the present disclosure, even if the air inside resin case 12 is expanded by heat from reflow soldering, the air is allowed to pass through through hole 125 and groove 16, and be released to the outside of push switch 11 from exposed part 161. Accordingly, it is also possible to suppress deformation or breakage of upper protection sheet 14, lower protection sheet 15, and resin case 12 caused by heat from reflow soldering.

Push switch 11 of the present disclosure may be configured in the following manner.

As illustrated in FIG. 2, groove 16 may extend toward second side surface 1212 of resin case 12 different from first side surface 1211.

As illustrated in FIG. 2, groove 16 may extend in a bent manner.

As illustrated in FIG. 5, groove 16 has groove side surface 162, and end 163 formed in exposed part 161. End 163 and groove side surface 162 may be connected by a curve in plan view.

As illustrated in FIG. 1, push switch 11 of the present disclosure may also have wall 126 protruding from lower surface 122 of resin case 12.

As illustrated in FIG. 2, wall 126 may be disposed away from groove 16 and through hole 125. Moreover, wall 126 may be disposed between lower protection sheet 15 and connection terminal 13. Moreover, wall 126 may surround the outer periphery of lower protection sheet 15.

As illustrated in FIG. 1, push switch 11 of the present disclosure may also have multiple fixed contacts 17 provided inside resin case 12, and movable contact 18 provided inside recess 124 of resin case 12. Multiple fixed contacts 17 are connected to connection terminals 13. When movable contact 18 comes into contact with multiple fixed contacts 17, multiple fixed contacts 17 are electrically connected to each other. When movable contact 18 separates from multiple fixed contacts 17, multiple fixed contacts 17 are electrically separated from each other.

INDUSTRIAL APPLICABILITY

As has been described, the push switch according to the present disclosure has an effect of suppressing deformation or breakage of a protection sheet and a resin case. The push switch of the present disclosure is particularly useful as a reflow-soldered push switch or the like.

REFERENCE MARKS IN THE DRAWINGS

11 push switch
12 resin case
13 connection terminal
14 upper protection sheet
15 lower protection sheet
16 groove
17 fixed contact
18 movable contact
121 side surface
122 lower surface
123 upper surface
124 recess
125 through hole
126 wall
131 first connection terminal
132 second connection terminal
151 adhesive agent
160 area
161 exposed part
162 groove side surface
163 end
164 bottom
171 first fixed contact
172 second fixed contact
1211 first side surface
1212 second side surface
1261 corner

The invention claimed is:

1. A push switch comprising:

a resin case that has four side surfaces, an upper surface and a bottom surface, the resin case comprising a recess including a bottom part which has a through hole and a groove;

a connection terminal that extends from a first side surface among the four side surfaces of the resin case toward an outside of the resin case;

an upper protection sheet that is provided on the upper surface of the resin case in such a manner as to cover the recess; and a lower protection sheet that is provided on the lower surface of the resin case, wherein:

the bottom part has a first surface as a bottom of the recess and a second surface opposite to the first surface, the second surface constituting a part of the lower surface of the resin case, the through hole passes through the bottom part, the groove is provided on the second surface of the bottom part, the through hole and the groove are connected to each other within the bottom part, the through hole overlaps with the lower protection sheet in plan view, and the groove has a first groove and a second groove continuous from the first groove, and of the first groove and the second groove, only the first groove overlaps with the lower protection sheet in plan view.

2. The push switch according to claim 1, wherein the groove extends toward a second side surface of the four side surfaces of the resin case different from the first side surface.

3. The push switch according to claim 1, wherein the groove extends in a bent manner.

4. The push switch according to claim 1, wherein:

the groove has a groove side surface, and an end formed in the second groove, and the end and the groove side surface are connected by a curve in plan view.

5. The push switch according to claim 1, further comprising:

a plurality of fixed contacts provided over the bottom of the resin case; and a movable contact provided over the bottom of the recess of the resin case, wherein:

the plurality of fixed contacts are connected to the connection terminal, when the movable contact comes into contact with the plurality of fixed contacts, the plurality of fixed contacts are electrically connected to each other, and when the movable contact separates from the plurality of fixed contacts, the plurality of fixed contacts are electrically separated from each other.

6. The push switch according to claim 1, wherein at least one electrode is disposed on the first surface of the bottom part.

7. The push switch according to claim 1, further comprising a wall that protrudes from the lower surface of the resin case, wherein the wall is disposed away from the groove and the through hole.

8. The push switch according to claim 7, wherein the wall is disposed between the lower protection sheet and the connection terminal.

9. The push switch according to claim 8, wherein the wall surrounds an outer periphery of the lower protection sheet.

* * * * *